US005755819A

United States Patent [19]

Bonanni et al.

[11] Patent Number: 5,755,819

[45] Date of Patent: May 26, 1998

[54] PHOTODIODE ARRAY FOR ANALYSIS OF MULTI-BURNER GAS COMBUSTORS

[75] Inventors: Pierino Gianni Bonanni; Kenneth Alan Wesley Marcelle, both of Niskayuna, N.Y.

[73] Assignee: General Electric Company, Schenectady, N.Y.

[21] Appl. No.: 656,003

[22] Filed: May 24, 1996

[51] Int. Cl.[6] ..... F23N 5/08

[52] U.S. Cl. ..... 431/79; 431/78; 431/12; 431/2; 431/6; 431/18

[58] Field of Search ..... 431/79, 78, 18, 431/2, 6, 12; 340/578; 60/39.03

[56] References Cited

U.S. PATENT DOCUMENTS

| | | | |
|---|---|---|---|
| 5,257,496 | 11/1993 | Brown et al. . | |
| 5,303,684 | 4/1994 | Brown et al. . | |
| 5,467,185 | 11/1995 | Engeler et al. . | |
| 5,480,298 | 1/1996 | Brown . | |
| 5,487,266 | 1/1996 | Brown | 60/39.06 |
| 5,544,478 | 8/1996 | Shu et al. | 60/39.03 |

OTHER PUBLICATIONS

U.S. Patent Application "Double Window for Optical Sensor" By Shu, et al. Ser. No. 08/425,548 Filed Jun. 20, 1995.

U.S. Patent Application "Photocurrent Detector Circuit" By Brown, et al. Ser. No. 08/474,238 Filed Jun. 7, 1995.

"Nitrogen-implanted Sic Diodes Using High-temperature Implantation" By Ghezzo, et al. IEEE Electron Divice Letters, vol. 13, No. 12, Dec. 1992, pp. 1-3.

"Silicon Carbide UV Photodiodes" By Brown, et al. IEEE Transactions On Electron Devices, vol. 40, No. 2, Feb. 1993, pp. 325-333.

"Boron-Implanted 6-H Sic Diodes" By Ghezzo, et al Appl. Phys. Lett 63(9), Aug. 1993, pp. 1206-1208.

"Detection, Estimation, and Linear Modulation Theory" By HL Van Trees, pp. 52-65.

*Primary Examiner*—Larry Jones

*Attorney, Agent, or Firm*—Ann M. Agosti; Marvin Snyder

[57] ABSTRACT

A detection system includes flame sources at least two of which are independently controllable; photodetectors each having an independent view of the flame sources and being capable of producing a respective current signal in response to flames produced by the flame sources; and a device for analyzing the current signals to determine state values of a plurality of state variables and transform the state values into at least one parameter value. A number of the flame sources is at least as high as a number of the state variables, and a number of the photodetectors is at least as high as the number of the state variables. In one embodiment, the flame sources include gas burners in a gas combustion chamber, the photodetectors include silicon carbide photodiodes, and the parameter value is representative of fuel rate, temperature, acoustic dynamics, nitrogen oxide concentration, or carbon monoxide concentration. The device for analyzing the current signals can include means for mapping each of the current signals with respect to the state variables and inversely mapping the current signals and the state variables to determine the dependence of each of the state variables with respect to the current signals.

11 Claims, 3 Drawing Sheets

PHOTODIODE ARRAY FOR ANALYSIS OF MULTI-BURNER GAS COMBUSTORS

BACKGROUND OF THE INVENTION

The fuel efficiency, emission quality, and life span of gas turbines depend upon the ability to maintain stable combustion and a proper fuel-to-air flow ratio in combustor chambers. To meaningfully assess combustor performance requires monitoring of various bulk characteristics such as temperature, acoustic pressures, and concentrations of combustion byproducts.

The combustion environment is hostile to most electronic equipment, so direct combustion monitoring is difficult when the turbine is in its normal operating state. For this reason, combustor tuning is traditionally performed either off-line (i.e., when the turbine is not in service and can be fitted with the requisite instrumentation) or on-line using measurements taken downstream of the combustor. In off-line monitoring, the tuning is static, and poor performance can result if conditions change during actual operation. In on-line downstream monitoring, the measurements are generally not well correlated to the characteristics of interest.

Commonly assigned Brown et al., U.S. Pat. No. 5,257,496, issued Nov. 2, 1993, discloses the use of spectrometry at non-infrared wavelengths to monitor the fuel-to-air ratio and nitrogen oxide (NOx) emissions in a gas combustor. A silicon carbide photodiode that can withstand high temperatures is described in Brown et al., "Silicon Carbide UV Photodiodes," IEEE Transactions in Electron Devices, Vol. 40, No. 2, February, 1993, pp. 325–33.

SUMMARY OF THE INVENTION

It would be desirable to have a monitoring technique for precisely determining the actual distribution of fuel to multiple burners within a single combustor chamber which can operate at high temperatures and provide both on-line and direct real-time measurement of the combustion process.

The present invention monitors the conditions in a multi-burner gas combustor using an array of (at least two) photodetectors. Preferably the photodetectors comprise devices which can operate properly in high temperature environments such as, for example, silicon carbide photodiodes. The photodiodes are positioned in optical sight of but in thermal isolation from the combustor chamber. Each photodiode primarily views one respective independently controlled flame source but is responsive to ultraviolet emission from all of the flame sources because of its wide field of view, lateral spreading of combustor flames, and internal reflections. The distribution and intensity of ultraviolet emission from the flame sources is directly related to the combustion state.

Because silicon carbide devices can withstand high temperatures (up to 800 degrees Fahrenheit), small quartz windows on the chamber wall can provide sufficient thermal isolation for the devices while maintaining the requisite optical coupling. An algorithm can be used to process the resulting photodiode measurements so as to mathematically decouple them and infer combustion parameters of interest. In particular, a method is presented for estimating the fuel distribution to individual flames, and various bulk properties of the combustion process including temperature, acoustic dynamics, nitrogen oxide (NOx) concentrations, and carbon monoxide (CO) concentrations.

In this manner, a method and apparatus are provided for direct, on-line measurement of the fuel distribution and resulting combustion state of a multi-burner gas combustor. In-service tuning of the combustor flames can thus be performed without the addition of expensive metering equipment or significant changes to the combustor design. Another advantage is that the on-line measurements can provide the basis for a closed-loop combustion control system which can enhance turbine performance over a wide range of load conditions by adaptively ensuring an optimum balance between power output and pollutant emissions.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings, where like numerals represent like components, in which:

DETAILED DESCRIPTION OF A PREFERRED EMBODIMENT OF THE INVENTION

Although the present invention is described with respect to FIGS. 1 and 2 as including a five-flame source and two-photodetector configuration, as discussed below, any one of a number of various combinations of flames and photodetectors can be used. Moreover, although the photodetectors are described as photodiodes, such as silicon carbide photodiodes, any photodetection device which can withstand the particular environment can be used.

Figure 1:
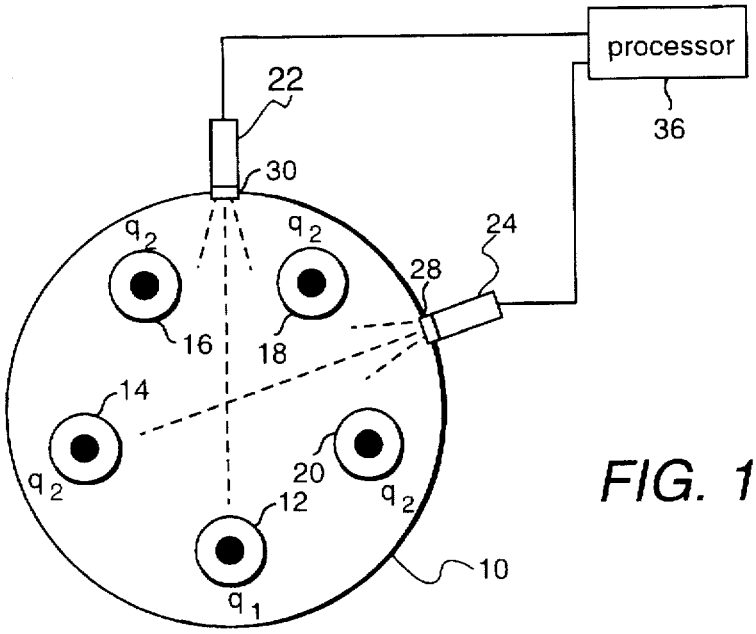
FIG. 1 is a top view of a detection system of the present invention.
Figure 2:
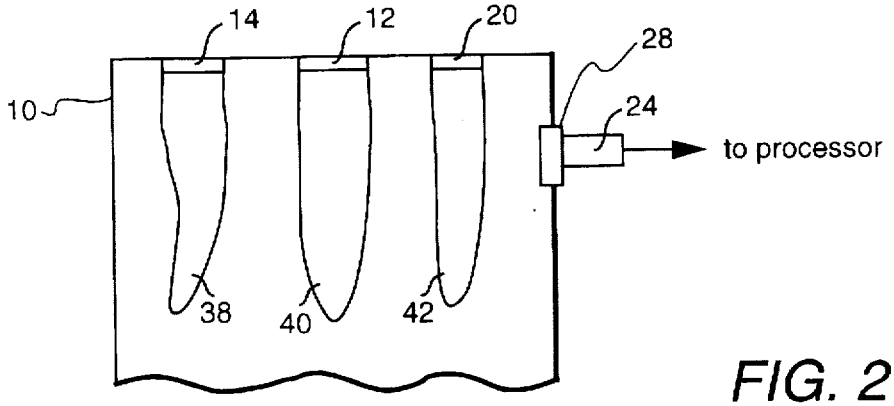
FIG. 2 is a cut away side view of several flame sources with respective flames.

FIG. 1 is a top view of a detection system in the present invention. In FIG. 1, an annular arrangement of five flame sources (shown as gas burners 12, 14, 16, 18, and 20) in a single combustor chamber 10. The sensor array includes two photodetectors (shown as photodiodes 22 and 24) which are mounted outside the chamber to view flames from the burners. FIG. 2 is a cut away side view of several burners 14, 12, and 20 with respective flames 38, 40, and 42. Each photodiode views the burners through a window capable of operation under high temperature conditions. In one embodiment, the photodiodes comprise silicon carbide photodiodes, and two windows 28 and 30 each comprise quartz. A useful double window embodiment is described in Shu et al., "Double Window for Optical Sensors," U.S. application Ser. No. 08,425,548, filed Apr. 20, 1995.

The photodiodes are positioned to obtain independent views of the gas burner flames. It is advantageous for each photodiode to have a view as distinct as possible from each other photodiode. Preferably each of the two photodiodes is aligned to directly view a flame of a respective gas burner. As shown in the embodiment of FIG. 1, photodiode 22 directly views burner 12, and photodiode 24 directly views burner 14.

Burner 12 is assumed to be governed by a state variable q1, while burners 14, 16, 18, and 20 are assumed to be governed by a state variable q2. It is assumed that q1 and q2 constitute the complete combustion state (q1, q2). For example, in the two photodiode embodiment of FIG. 1, q2 represents all the flame sources not represented by q1. Therefore, when an estimation of the state variables is made, fuel rate parameter values and bulk properties that depend upon fuel rate such as average temperature, NOx and CO concentrations, and acoustic dynamics, can be determined. The determination of acoustic dynamics, unlike the determination of the other parameters, requires review of the time variation of the measured current.

The designation of a single burner 12 being governed by state variable q1 is for illustrative purposes only. In some combustor designs, a single burner is run slightly fuel rich while the remaining burners are run more conservatively (i.e., under "lean burn" conditions). If desired, however, multiple burners can be governed by state variable q1.

In fact, some or all of the burners can be governed by selected combinations of the state variables, if desired. For example, a function of gas burner 16 can be governed by ¼ of q1 plus ¾ of q2, and a function of gas burner 18 can be governed by ½ of q1 plus ½ of q2. What is important is that the number of photodiodes equals or exceeds the number of state variables and that the set (q1 and q2 in this example) completely defines the combustion state.

Because of internal reflections and lateral spreading of combustor flames, photodiode 22 responds to radiation emitted by burners 14, 16, 18, and 20 in addition to the radiation emitted by burner 12. Likewise, photodiode 24 responds to radiation from each of burners 12, 14, 16, 18, and 20.

Figure 3:
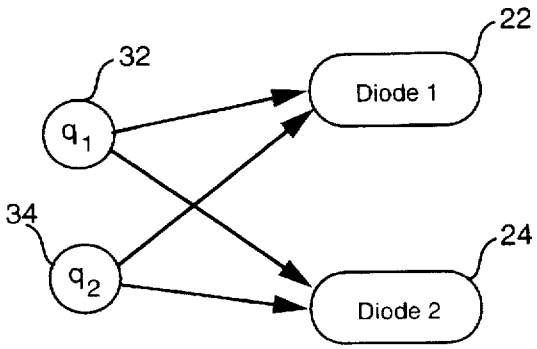
FIG. 3 is a schematic illustration of the relation between state variables and photodetectors.

FIG. 3 is a schematic illustration of the relation between state variables shown as q1 32 and q2 34 and photodiodes 22 and 24. Each output signal (i1 and i2) of a photodiode depends on the complete combustor state (q1, q2).

Figure 5:
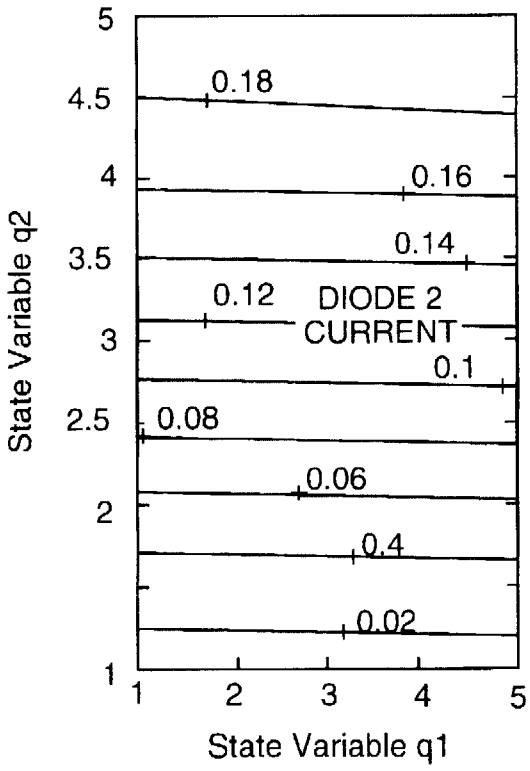
FIGS. 4 and 5 are expected contour plots demonstrating how measured currents of the photodetectors might depend on the state variables.
Figure 4:
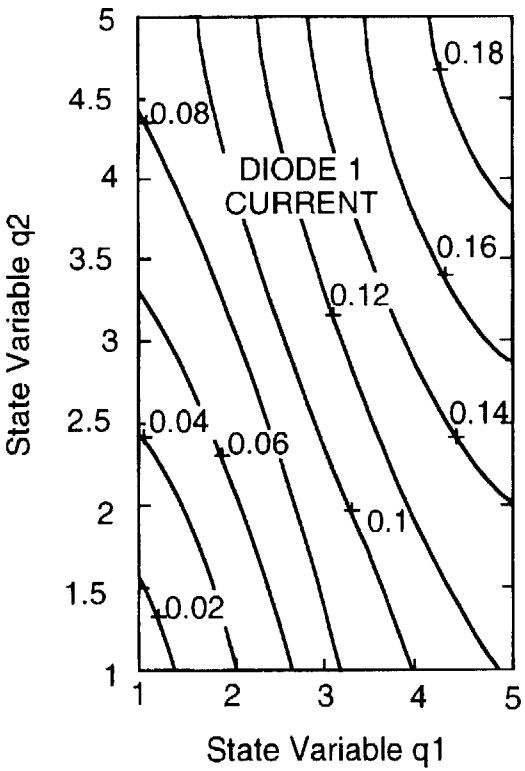

FIGS. 4 and 5 are contour plots demonstrating how measured currents i1 and i2 of the respective photodiodes 22 and 24 might depend on the state variables q1 and q2, given specific mounting locations for the two photodiodes.

These plots are obtained by running mapping experiments prior to actually running the combustor in normal operation. While the currents are mapped with respect to the state variables, other parameters of interest which depend upon the state variables, such as fuel rate, temperature, NOx concentration, CO concentration, and acoustic dynamics, can also be characterized by theoretical estimations or experiments.

As shown in FIG. 4, i1 depends strongly on both q1 and q2, and, as shown in FIG. 5, i2 depends predominantly on q2. The dependencies can change significantly depending on the chamber size, the flame widths, the placement of the photodiodes, the flame positions, and the burner properties, for example.

Figure 7:
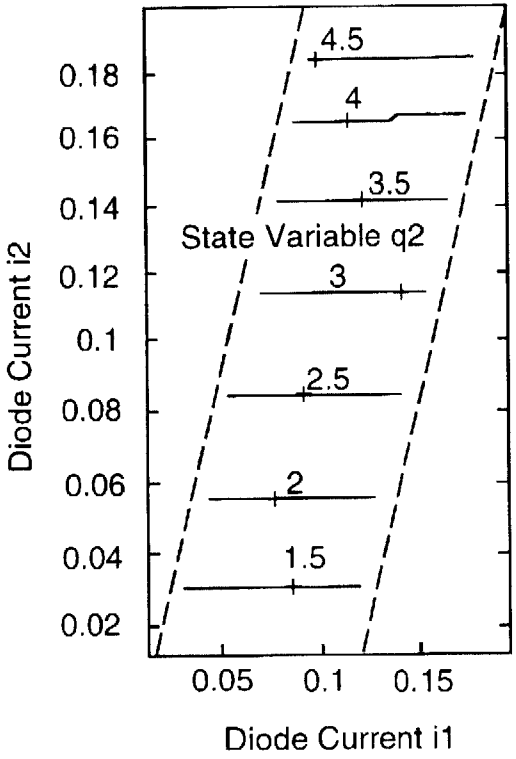
FIGS. 6 and 7 are contour plots resulting from inversely mapping the contour plots of FIGS. 4 and 5 to show how the state variables could be inferred from the measured currents.
Figure 6:
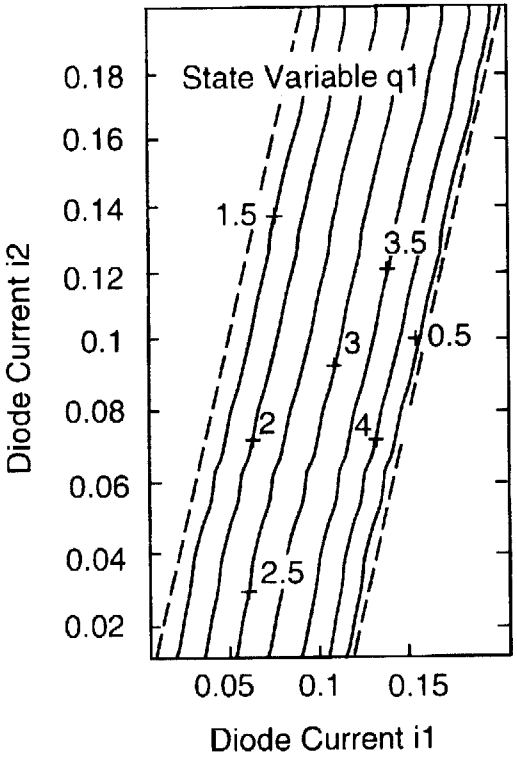

FIGS. 6 and 7 are contour plots resulting from inversely mapping the contour plots of FIGS. 4 and 5 to show how the state variables depend on the measured currents.

These contour plots are useful when the combustor is in operation because they illustrate the best choice of the unknown combustor state variables (q1, q2) given possible combinations of the photodiode currents (i1, i2). In one embodiment, the contour plots of FIGS. 6 and 7 are generated prior to normal combustor operation and used as a "look-up" table during normal combustor operation. In another embodiment the inverse mapping calculations are performed during normal combustor operation.

Using the relationship between the combustor state (q1, q2) and the sensor state (i1, i2), an inverse relationship can be derived to create a mapping between (i1, i2) and (q1, q2), and thus provide information for obtaining parameters of interest such as fuel rate, temperature, pollutant concentrations, and acoustic amplitudes.

Mathematically the mapping can be expressed as a minimum distance criterion as follows:

Given a set of measured photodiode currents ($i1^m$, $i2^m$), find that set of parameters (q1, q2) such that i1(q1, q2) and i2(q1, q2) lie closest to the pair ($i1^m$, $i2^m$).

The conditions under which the mapping is possible call for a correspondence between a given combination of state variables and a respective combination of photodiode currents. Interpreted graphically, this means that if the two contour plots in FIGS. 4 and 5 were to be superimposed, each contour of the i1 graph (FIG. 4) would intersect a given contour of the i2 graph (FIG. 5) at only one location. This graphical interpretation applies only to the illustrated example of two state variables and two photodiode currents.

The value of q1 and q2 at which an intersection of contours occurs provides an approximate state variable estimate of the photodiode currents corresponding to the intersecting contours. The exact intersection point of the two plots of FIGS. 4 and 5 does not necessarily provide the precise state variable values, however, because noise can interfere with the current measurements. Preferably a technique for factoring noise such as the maximum likelihood method or other nonlinear parameter estimation method is used. Discussions of estimation theory can be found in reference books such as, for example, H. L. Van Trees, *Detection, Estimation, and Modulation Theory* (John Wiley & Sons 1968).

In the present example, no solutions exist in regions where i1 and i2 are not of approximately equal magnitude (i.e., outside the bounds of the dotted lines). These regions correspond to those combinations of i1 and i2 that are physically unrealizable and thus to those combinations of $i1^m$ and $i2^m$ that are least likely to occur in practice.

The precise placement of the sensors is critical to the shape of the forward and reverse mappings described with respect to FIGS. 4–7 because of the strong influence of position on the observed ultraviolet emission. Performance of the sensing techniques can thus be optimized by strategic choice of the sensor locations.

For example, by positioning the photodiodes to each have a view as distinct from one another as possible, it is less likely that the contours will look similar and therefore uncertainties are minimized. The expected graph of FIG. 4 differs greatly from that of FIG. 5 because of the different views which would be obtained by the photodiodes in FIG. 1.

Two types of positioning issues are present: azimuthal and axial. The azimuthal position determines the angle between the photodiodes. The closer the photodiodes are physically together, the more the contours appear the same. The axial position is the height along the combustor at which a photodiode is positioned. For example, in FIG. 2, the photodiode is shown as being positioned to view the center regions of the flames. Empirical or mathematical analysis of the sensitivity of the inverse mapping can be performed for several sample photodiode locations to determine which locations provide minimum sensitivity of the state parameter estimates to noise on the current signals i1 and i2.

In some situations wherein the photodiode views are not sufficiently different, the contours of the two plots of FIGS. 4 and 5 may be close to parallel or a contour of one plot may intersect a contour of another plot in more than one location. Additional sensor data or a priori knowledge must be included in these situations to perform the reverse mapping. One technique for addressing multiple overlaps is to have more photodiodes than state variables and therefore provide more data for ambiguity resolution.

The above-described embodiment of the two-parameter, two sensor case extends naturally to multiple-parameter, multiple-sensor cases, provided that the problem is fully constrained. The number of burners must be at least as large as the number of state variables. Additionally, the number of photodetectors must be at least as large as the number of state variables.

In over-constrained embodiments wherein sensor measurements exceed the number of parameters, conflicting measurements are naturally resolved by applying the mathematically expressed minimum distance criterion discussed above.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A detection system comprising:

flame sources, at least two of the flame sources being independently controllable;

photodetectors, each of the photodetectors having an independent view of the flame sources and being capable of producing a respective current signal in response to flames produced by the flame sources; and a device for analyzing the current signals to determine state values of a plurality of state variables and transform the state values into at least one parameter value, wherein a number of the flame sources is at least as high as a number of the state variables, and a number of the photodetectors is at least as high as the number of the state variables.

2. The system of claim 1, wherein the flame sources comprise gas burners in a gas combustion chamber and the photodetector is capable of withstanding high temperatures.

3. The system of claim 2, wherein the at least one parameter value is representative of fuel rate, temperature, acoustic dynamics, nitrogen oxide concentration, or carbon monoxide concentration.

4. The system of claim 2, wherein the photodetectors comprise photodiodes.

5. The system of claim 4, wherein the photodiodes comprise silicon carbide photodiodes.

6. The system of claim 1, wherein the device for analyzing the current signals includes means for mapping each of the current signals with respect to the state variables and inversely mapping the current signals and the state variables to determine the dependence of each of the state variables with respect to the current signals.

7. A detection method comprising:

independently viewing a plurality of flame sources, at least two of which are independently controllable, using at least two photodetectors, each of the at least two photodetectors producing a respective current signal in response to flames produced by the flame sources;

analyzing the current signals to determine values of a plurality of state variables, wherein a number of the flame sources is at least as high as a number of the state variables, and a number of the photodetectors is at least as high as the number of the state variables; and transforming the state values into at least one parameter value.

8. The method of claim 7, wherein the at least one parameter value is representative of fuel rate, temperature, acoustic dynamics, nitrogen oxide concentration, or carbon monoxide concentration.

9. The method of claim 7, wherein the step of analyzing the current signals includes mapping each of the current signals with respect to the state variables and inversely mapping the current signals and the state variables to determine the dependence of each of the state variables with respect to the current signals.

10. The method of claim 9, wherein the step of mapping each of the current signals occurs before the flame sources are used in normal operation.

11. The method of claim 10, wherein the step of inversely mapping the current signals occurs before the flame sources are used in normal operation.

* * * * *